United States Patent [19]

Mardix et al.

[11] Patent Number: 4,932,343

[45] Date of Patent: Jun. 12, 1990

[54] SEWING APPARATUS

[75] Inventors: Bar`C. Mardix, Ramat Gan; Yaakov Sadeh, Nes Ziona; Yaakov Makover, Moshav Beit Elazari, all of Israel

[73] Assignee: Orisol Original Solutions Ltd., Loo, Israel

[21] Appl. No.: 298,076

[22] Filed: Jan. 18, 1989

[30] Foreign Application Priority Data

Jan. 21, 1988 [IL] Israel 85169

[51] Int. Cl.[5] ..... D05B 21/00

[52] U.S. Cl. ..... 112/121.12; 112/308

[58] Field of Search ..... 112/121.12, 121.15, 112/308, 309, 102, 103, 2, 153, 311, 320

[56] References Cited

U.S. PATENT DOCUMENTS 3,474,747 10/1969 Noiles ..... 112/121.12
4,419,946 12/1983 Fischer et al. ..... 112/308 X
4,497,269 2/1985 Schneider et al. ..... 112/103 X
4,498,404 2/1985 Sadeh ..... 112/121.12
4,526,116 7/1985 Mannel ..... 112/121.12
4,834,008 5/1989 Sadeh et al. ..... 112/121.12

*Primary Examiner*—Peter Nerbun
*Attorney, Agent, or Firm*—Benjamin J. Barish

[57] ABSTRACT

Sewing apparatus includes a manipulator for manipulating the workpiece comprising a pressure member having a sheet of friction material pressable against the workpiece for sliding it over the work table. The manipulator includes a vertically-mounted stand, three pivotal links, and three rotary drives mounted on the stand and coupled to their respective links. The apparatus further includes an optical detector and a lamp illuminating the workpiece obliquely in order to emphasize its edges by the shadows produced.

6 Claims, 4 Drawing Sheets

SEWING APPARATUS

BACKGROUND OF THE INVENTION

The present invention relates to sewing apparatus, and particularly to automatic sewing apparatus of the computerized type especially useful in the footwear and garment manufacturing industries.

The currently-used computerized sewing apparatus generally includes X-Y servo systems for controlling the movement of the workpiece along the X- and Y-coordinates, and for controlling the sewing head drive. However, the known systems generally require complex clamping devices for moving the workpieces with respect to the sewing head, and for retaining them in place and in fixed shape during the sewing operations. Such complex clamping devices are quite costly and time-consuming to produce. A further drawback in the current computerized sewing systems is that the workpiece itself is not always accurately cut so that the stitching applied to the workpiece may not present the best appearance. This is particularly true when the stitching is applied along the edge of the workpiece, as is frequently done in the garment and footwear industries.

U.S. Pat. No. 4,498,404 discloses one form of automatic sewing apparatus directed particularly to improving the above drawbacks. The sewing apparatus therein described obviates the need for complicated clamping arrangements by including a suction head type manipulator, and improves the appearance of the stitched workpiece by providing an optical device for optically detecting the edge of the workpiece to receive the stitches.

BRIEF SUMMARY OF THE INVENTION

An object of the present invention is to provide automatic sewing apparatus also directed to the above-described drawbacks of the existing apparatus but providing improved arrangements for curing those drawbacks.

According to one aspect of the present invention, there is provided sewing apparatus including a main frame, a sewing head mounted thereon, a horizontal table carried by the main frame for receiving a workpiece to be sewn, and a manipulator for manipulating the workpiece on the table with respect to a sewing station; characterized in that the manipulator comprises a pressure member including a sheet of friction material pressable against the workpiece for sliding it over the table. Preferably, the sheet of friction material has the same general configuration as the workpiece but is of slightly shorter dimensions to provide an exposed margin of the workpiece to receive sewing stitches from the sewing head.

According to another feature in the described preferred embodiment, the manipulator includes a vertically-mounted stand; a first horizontal link pivotably mounted at one end to the stand; a second horizontal link pivotably mounted at one end to the opposite end of the first link, and pivotably carrying the pressure member at its opposite end; a first rotary drive mounted to the stand and coupled to the first horizontal link to pivot same with respect to the vertical stand; a second rotary drive mounted to the stand and coupled to the second horizontal link to pivot same with respect to the first horizontal link; and a third rotary drive mounted to the stand and coupled to the pressure member to pivot same with respect to the second horizontal link. It will thus be seen that in such an arrangement the drives (motors) are directly supported on the stand, and are not supported by the links (arms) of the manipulator, thereby enabling the links to be manipulated with very low response times.

According to a still further feature in the described preferred embodiment, the apparatus further includes an optical detector oriented to view the sewing section of the table underlying the sewing head, and a lamp oriented obliquely with respect to the sewing station to illuminate a workpiece thereon and to emphasize the edges of the workpiece by the shadow produced by said oblique orientation of the lamp.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
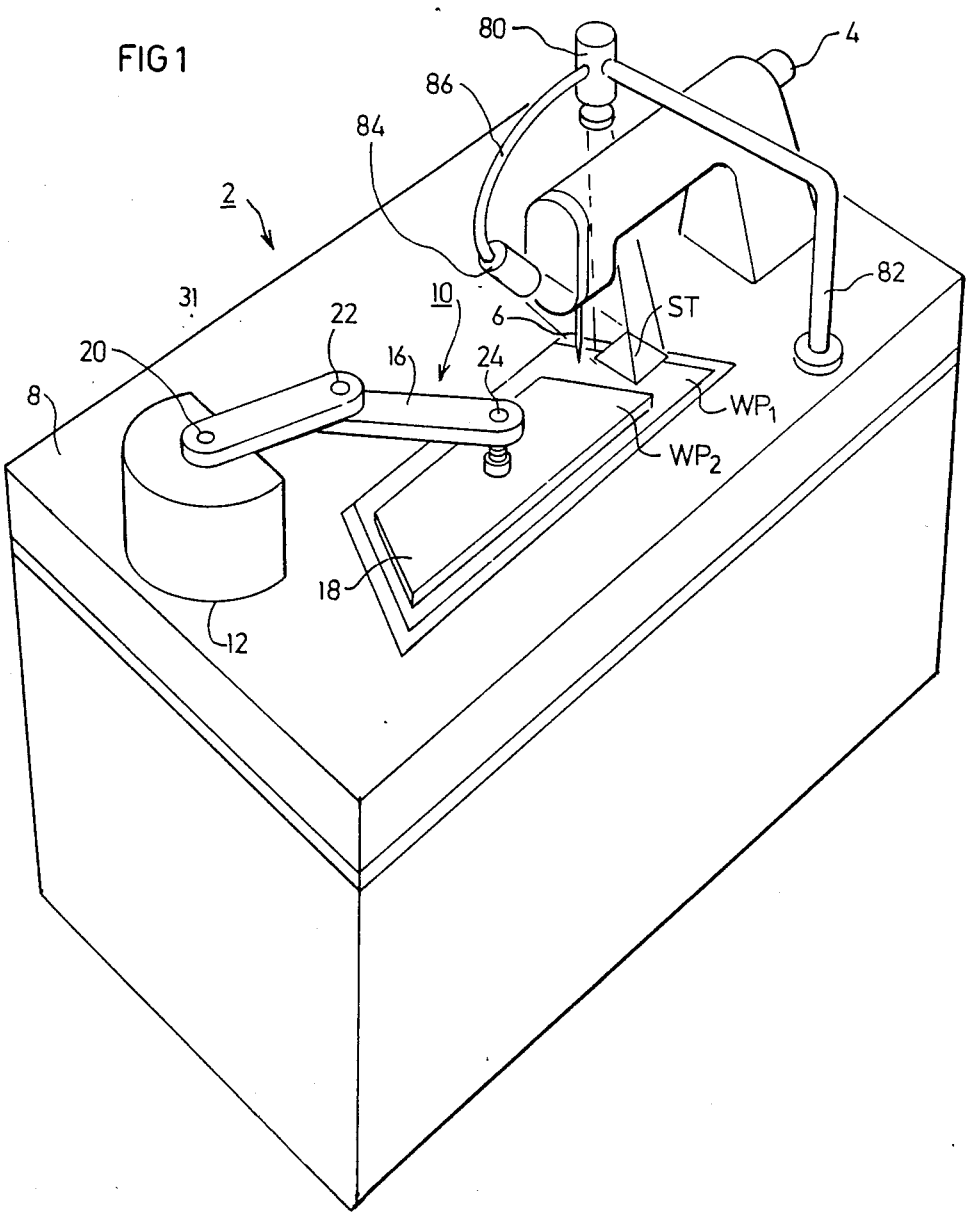
FIG. 1 is a three-dimensional view illustrating one form of computerized sewing apparatus constructed in accordance with the present invention.
Figures 4, 5:
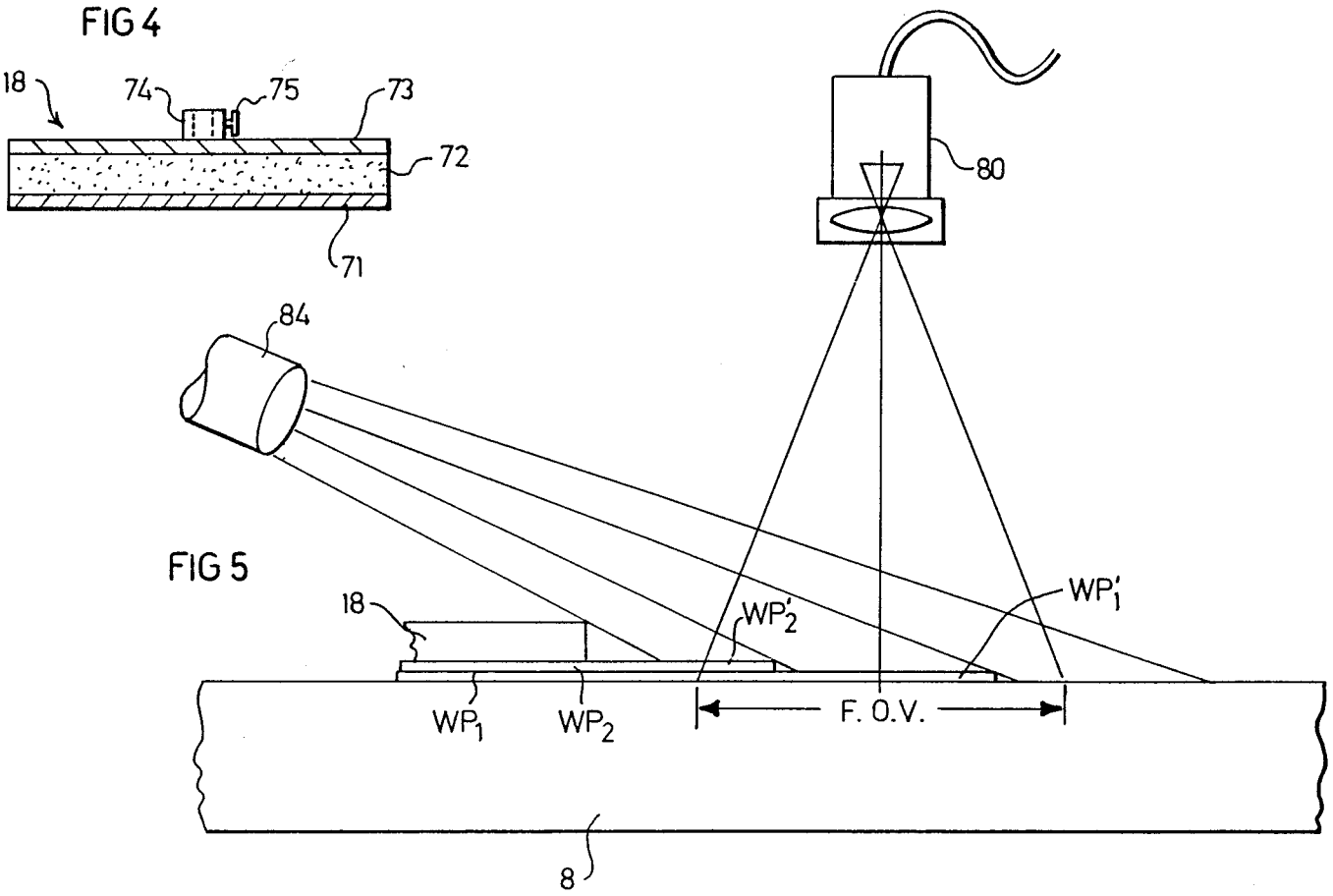
FIG. 4 is an assembled sectional view, illustrating the pressure member of the manipulator included in the apparatus of FIGS. 1 and 2.
FIG. 5 is a side elevational view illustrating the optical system in the sewing apparatus of FIG. 1.

The sewing apparatus illustrated in FIG. 1 comprises a main frame, generally designated 2, and a sewing head 4 fixedly mounted on the main frame and driving a needle 6 located in the sewing station. The main frame 2 further includes a horizontal table 8 for receiving the workpiece to be sewn, and a manipulator, generally designated 10, for manipulating the workpiece on table 8 with respect to the sewing needle 6 at the sewing station ST underlying the sewing head. For purpose of example, FIGS. 1 and 4 illustrate two workpieces, namely a larger workpiece $WP_1$ on top of which a smaller workpiece $WP_2$ is to be sewn by needle 6 in the sewing station ST.

Manipulator 10 is capable of manipulating the two workpieces to any commanded positions, as determined by the program, with respect to the sewing station ST and the needle 6 of the sewing head 4. The manipulator 10 comprises a vertical stand 12 pivotably mounting a first horizontal link 14, a second horizontal link 16, and a pressure member, generaly designated 18, engageable with the workpieces for manipulating them over the sewing table 8. Horizontal link 14 is pivotable at one end along vertical axis 20 of the vertical stand 12, and horizontal link 16 is pivotably mounted along vertical axis 22 to the opposite end of link 14. The pressure member 18, engageable with the workpieces $WP_1$, $WP_2$, is pivotably mounted to the opposite end of horizontal link 16 along vertical axis 24.

Figure 2:
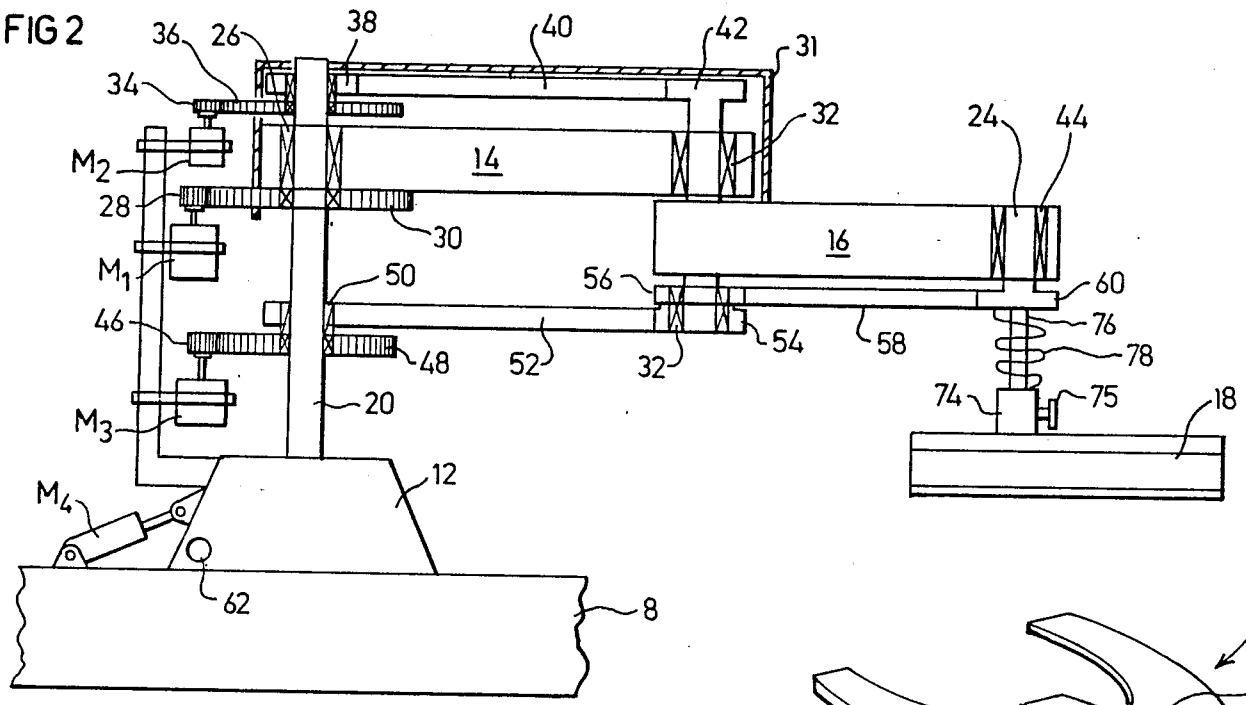
FIG. 2 is a side elevational view particularly showing the workpiece manipulator and the various drives associated therewith.

FIG. 2 illustrates the drives for pivoting the horizontal links 14, 16, and the pressure member 18 at the end of link 16. As shown in FIG. 2, horizontal link 14 is rotatably mounted to shaft 20 of the vertical stand 12 by a bearing 26; and rotary motion is transferred to the link by an electric motor $M_1$ supported by the stand and driving a gear 28 meshing with a gear 30 carried by the link 14, all enclosed within a cover 31. Link 16 is rotatably mounted to the opposite end of link 14 by bearing 32, and is rotated by a second motor $M_2$, also supported by and within the vertical stand 12; and rotary motion is transferred to link 16 by motor $M_2$ which drives a gear 34 meshing with another gear 36 coupled by pulley 38, belt 40, and pulley 42, to horizontal link 16.

The pressure member 18, which actually engages the workpieces, is rotatably mounted to the end of link 16 by bearing 44, and is rotated by a third motor $M_3$, also supported by and within the vertical stand, and driving a gear 46 which meshes with another gear 48. Gear 48 is coupled to the pressure member 18 by a first pulley assembly including a pulley 50, belt 52 and one side of a pulley 54, and a second pulley assembly including the other side of pulley 54, belt 58 and pulley 60.

As will be described more particularly below, pressure member 18 includes a sheet of friction material pressable against the workpieces $WP_1$, $WP_2$. Thus, by controlling motors $M_1$, $M_2$ and $M_3$, the pressure member 18 may be moved to any position on table 8, and may be oriented in any direction, in order to slide the workpieces over the table to the proper position with respect to the sewing station ST underlying the sewing needle 6, according to the programme of stitches to be applied to the workpieces.

The manipulator assembly 10, and particularly its pressure member 18, may also be moved towards and away from the table in order to engage and disengage the workpieces. For this purpose, the vertical stand 12 is pivotably mounted about a horizontal pivot 62 and is coupled to a piston rod 64 of a hydraulic or pneumatic motor $M_4$.

Figure 3:
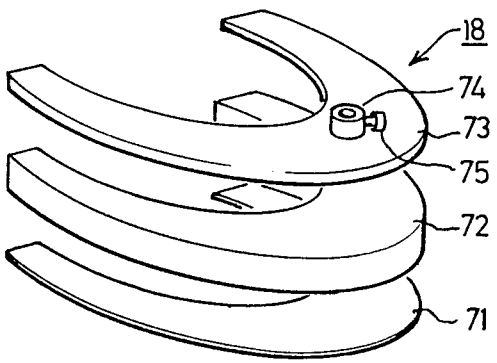
FIG. 3 is an exploded three-dimensional view.

The pressure member 18 carried at the end of the manipulator assembly 10 is more particularly illustrated in FIGS. 3 and 4. It includes three layers 71, 72, 73, and a sleeve 74 adapted to be releasably attached by a threaded fastener 75 to a stem 76 rotatably mounted by bearing 44 to the end of link 16 and rotated by pulley 60 driven by motor $M_3$. All three layers 71–73 of pressure member 18 are of the same general configuration as the uppermost workpiece $WP_2$ to be sewn to the underlying workpiece $WP_1$, except they are of smaller dimensions so as to provide an exposed margin, as shown at $WP_1'$ and $WP_2'$ in FIG. 5, for receiving the sewing stitches by the sewing head 4 in the sewing station ST.

The outermost layer 71, which actually contacts the uppermost workpiece $WP_2$, is a sheet of friction material, such as sand paper; the next layer 72 is a sheet of cushioning material, such as foam rubber or plastic; and the uppermost sheet 73 remote from the workpiece is preferably of cardboard, plastic or other suitable rigid or semi-rigid material.

The pressure member is resiliently mounted to link 16 by means of a spring, and is guided for vertical movement by stem 76 movable within pulley 60. For example, the upper end of stem 76 is splined to pulley 60 so as to be rotated thereby, but to permit axial movement in the vertical direction within the pulley by the spring mounting 78 of the pressure member 18.

In operation, pressure member 18 is pressed against the two workpieces $W_1$, $WP_2$ so as to flatten them against the table, while the friction layer 71 firmly engages the uppermost workpiece $WP_2$ so that the movement of the pressure member by the control of the manipulator drives $M_1$–$M_3$ will move the workpieces as desired over the table 8 in order to properly position the sewing margin of the workpieces with respect to the sewing needle 6 in the sewing station ST.

The sewing apparatus illustrated in the drawings further includes an optical detector 80 supported by a bracket 82 and oriented to view the sewing station ST. The apparatus further includes a lamp 84 supported by a bracket 86 and oriented obliquely with respect to the table and the sewing station ST so as to illuminate the workpieces in station ST. Lamp 84 also emphasizes the edges of the workpieces by the shadows produced by the oblique orientation of the lamp, as shown particularly in FIG. 5.

As one example, optical detector 80 may be a video camera such as a charge-couple device (CCD), and lamp 84 may be a flash lamp. The initiation of the flashes of lamp 84 is synchronized with the video camera 80 in order to produce stationary pictures even while the workpieces are in motion.

Figure 6:
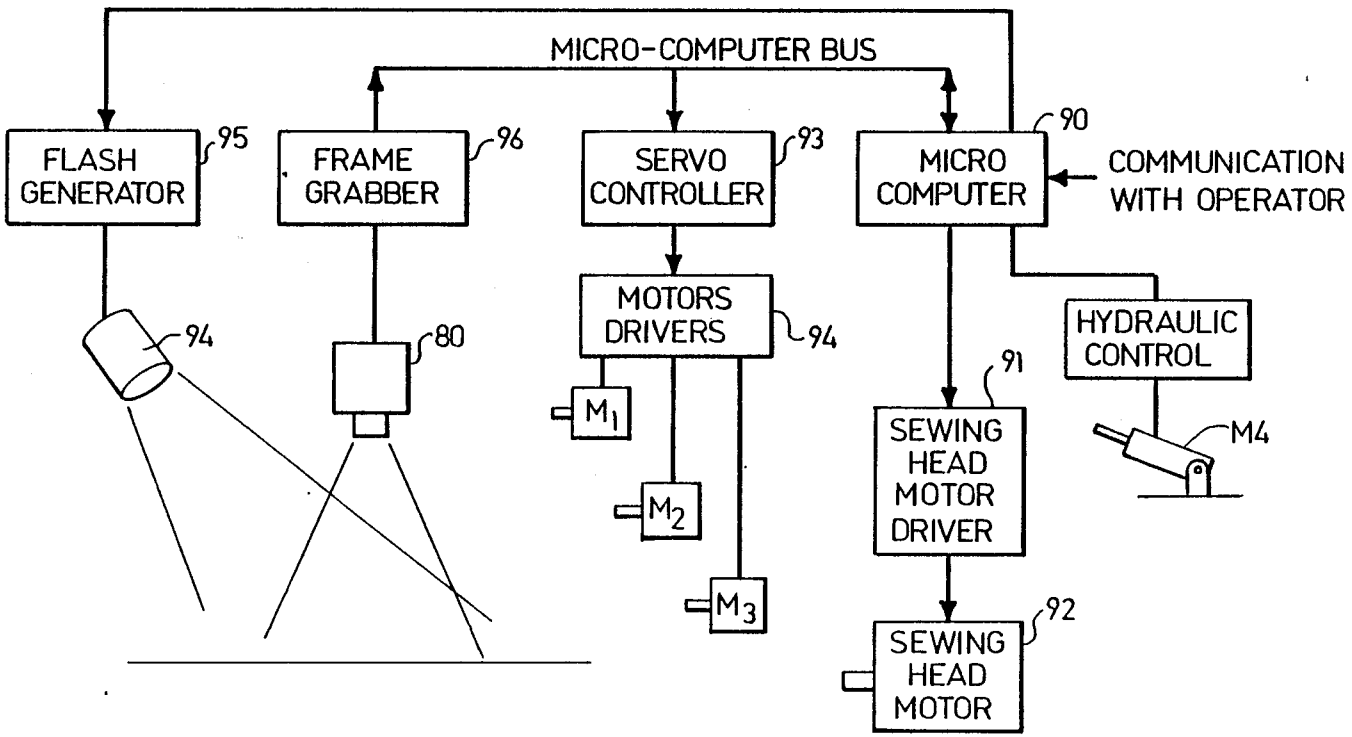
FIG. 6 is a block diagram illustrating the overall electrical control of the system of FIG. 1.

FIG. 6 illustrates the overall control system for the sewing apparatus described above. As shown in FIG. 6, the sewing apparatus is automatically controlled by a microcomputer 90. Microcomputer 90 also controls the sewing head 4 via the sewing head motor driver 91 and sewing head motor 92. The position of manipulator assembly 10 is further controlled by microcomputer 90 via a servo controller 93 which controls the drivers 94 for the motors $M_1$, $M_2$, and $M_3$. Microcomputer 90 further controls the flashing of the flash lamp 84 by a flash generator 95, and receives the picture from the video camera 80 via a frame grabber circuit 96 in order to produce stationary pictures while the workpieces are being moved by the manipulator assembly 10.

While the invention has been described with respect to one preferred embodiment, it will be appreciated that many variations, modifications and other applications of the invention may be made.

What is claimed is:

1. Sewing apparatus including a main frame, a sewing head mounted thereon, a horizontal table carried by said main frame for receiving a workpiece to be sewn, and a manipulator for manipulating the workpiece on the table with respect to a sewing station; characterized in that said manipulator includes a vertically-mounted stand;

a first horizontal link pivotably mounted at one end to said stand;

a second horizontal link pivotably mounted at one end to the opposite end of said first link, and pivotably carrying a pressure member at its opposite end;

a first rotary drive mounted to said stand and coupled to said first horizontal link to pivot same with respect to said vertical stand;

a second rotary drive mounted to said stand and coupled to said second horizontal link to pivot same with respect to said first horizontal link; and a third rotary drive mounted to said stand and coupled to said pressure member to pivot same with respect to said second horizontal link.

2. The apparatus according to claim 1, further including a pivotable drive for pivoting said vertical stand about a horizontal axis, to thereby lift said pressure member away from contact with the workpiece on the table.

3. The apparatus according to claim 1, including an optical detector oriented to view the sewing station of the table underlying the sewing head, and a lamp oriented obliquely with respect to said sewing station to illuminate a workpiece thereon and to emphasize the edges of the workpiece by the shadow produced by said oblique orientation of the lamp.

4. The apparatus according to claim 1, wherein said lamp is a flash lamp, and said optical detector is a video camera whose operation is synchronized with the flash lamp.

5. The apparatus according to claim 1, wherein said pressure member includes a sheet of friction material pressable against the workpiece for sliding it over the table, said sheet of friction material having the same general configuration as the workpiece but being of lightly shorter dimensions to provide an exposed margin of the workpiece to receive sewing stitches from the sewing head.

6. The apparatus according to claim 5, wherein said pressure member further comprises a cushioning layer of the same configuration as the sheet of friction material, and a base sheet also the same configuration as the sheet of friction material, said base sheet carrying said cushioning layer on one face and a clamp on the opposite face for removably clamping the pressure member to the manipulator.

* * * * *